US009531087B2

(12) United States Patent
Ying

(10) Patent No.: US 9,531,087 B2
(45) Date of Patent: Dec. 27, 2016

(54) MM WAVE ANTENNA ARRAY INTEGRATED WITH CELLULAR ANTENNA

(71) Applicant: Sony Corporation, Tokyo (JP)

(72) Inventor: Zhinong Ying, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 490 days.

(21) Appl. No.: 14/068,381

(22) Filed: Oct. 31, 2013

(65) Prior Publication Data

US 2015/0116169 A1 Apr. 30, 2015

(51) Int. Cl.

| | |
|---|---|
| ***H01Q 1/24*** | (2006.01) |
| ***H01Q 21/28*** | (2006.01) |
| ***H01Q 21/08*** | (2006.01) |
| ***H01Q 5/40*** | (2015.01) |
| *H01Q 9/04* | (2006.01) |
| *H01Q 23/00* | (2006.01) |

(52) U.S. Cl.

CPC ..... *H01Q 21/28* (2013.01); *H01Q 1/243* (2013.01); *H01Q 5/40* (2015.01); *H01Q 21/08* (2013.01); *H01Q 9/0421* (2013.01); *H01Q 23/00* (2013.01)

(58) Field of Classification Search

CPC ..... H01Q 1/243; H01Q 21/08; H01Q 21/28; H01Q 23/00; H01Q 5/40; H01Q 9/0421

USPC ..... 343/700 MS, 702, 725, 729, 741, 829,343/846, 853

See application file for complete search history.

(56) References Cited

U.S. PATENT DOCUMENTS

| | | | | |
|---|---|---|---|---|
| 4,839,659 | A * | 6/1989 | Stern | H01P 1/19 343/700 MS |
| 6,297,774 | B1 * | 10/2001 | Chung | H01Q 21/0087 343/700 R |
| 6,300,906 | B1 * | 10/2001 | Rawnick | H01Q 1/38 343/700 MS |
| 6,492,950 | B2 * | 12/2002 | Nakano | H01Q 9/0407 343/700 MS |
| 6,791,495 | B2 * | 9/2004 | Chang | H01Q 1/242 343/700 MS |
| 8,410,985 | B2 * | 4/2013 | Mercer | H01Q 1/243 343/700 MS |
| 8,648,752 | B2 * | 2/2014 | Ramachandran | H01Q 1/24 343/700 MS |
| 2008/0158084 | A1 | 7/2008 | Rofougaran | |
| 2008/0318524 | A1 | 12/2008 | Rofougaran | |
| 2011/0182174 | A1 | 7/2011 | Pi et al. | |
| 2011/0279338 | A1 | 11/2011 | Myszne et al. | |
| 2012/0098708 | A1 | 4/2012 | Takasu | |
| 2012/0235881 | A1 | 9/2012 | Pan et al. | |

OTHER PUBLICATIONS

International Search Report and Written Opinion Corresponding to International Application No. PCT/JP2014/004944; Date of Mailing: Dec. 5, 2014; 11 Pages.

* cited by examiner

*Primary Examiner* — Tho G Phan

(74) *Attorney, Agent, or Firm* — Myers Bigel, P.A.

(57) ABSTRACT

Wireless electronic devices may include a millimeter Wave (mmW) antenna array integrated with a cellular antenna. The devices may also include a package or module on the cellular antenna that integrates the mmW antenna array and an mmW circuit. The devices may also include a grounding element that includes an mmW antenna control and a power trace.

22 Claims, 8 Drawing Sheets

MM WAVE ANTENNA ARRAY INTEGRATED WITH CELLULAR ANTENNA

TECHNICAL FIELD

The present inventive concepts generally relate to the field of communications and, more particularly, to antennas and wireless electronic devices incorporating the same.

BACKGROUND 5G and WiFi systems and mobile terminals may utilize millimeter wave (mmW) bands to increase the available bandwidth for transmission. However, signals at millimeter wavelengths are susceptible to transmission loss from hand-blocking, atmospheric attenuation and other obstacles in the transmission path. If mmW antennas were to be added to a cellular mobile terminal, the mobile terminal may also suffer internal transmission loss due to the distance from the mmW antenna circuit module to the mmW antenna arrays.

SUMMARY

Various embodiments of the present inventive concepts include wireless electronic devices. According to some embodiments, a wireless electronic device may include a ground plane, a cellular antenna, a millimeter wave (mmW) antenna array coupled to a surface of the cellular antenna and an mmW circuit attached to the surface of the cellular antenna and coupled to the mmW antenna array. The mmW circuit may include circuit logic for feeding signals to mmW antennas of the mmW antenna array.

According to some embodiments, the mmW circuit may include an mmW transceiver and/or phase control circuit logic.

According to further embodiments, the wireless electronic device may also include a grounding element extending between the ground plane and the cellular antenna. The grounding element may include a power trace to provide power from circuitry on the ground plane to the mmW circuit. The grounding element may also include an mmW control line to provide mmW control signals from circuitry on the ground plane to the mmW circuit. The power trace and the mmW control line may be integrated on a flexible film.

In some embodiments, the mmW circuit logic is located within a perimeter of the surface of the cellular antenna.

In other embodiments, the wireless electronic device may include a feeding element coupled between the ground plane and the cellular antenna, wherein the cellular antenna, the grounding element, the feeding element and the ground plane form an antenna loop.

According to some embodiments, an integrated circuit package may include a millimeter wave (mmW) antenna array comprising a plurality of mmW antennas, and an mmW circuit coupled to the mmW antenna array and comprising circuit logic for feeding signals to the plurality of mmW antennas of the mmW antenna array. The integrated circuit package may be configured to attach onto a surface of a cellular radiating element.

In some embodiments, the mmW circuit may include an mmW transceiver. In other embodiments, the integrated circuit package may be coupled to a grounding element between a ground plane and the cellular radiating element. The grounding element may include a power trace to provide power to the mmW circuit and a control line to provide control signals to the mmW circuit.

In some embodiments, the integrated circuit package may be attached onto the surface of the cellular radiating element.

According to some embodiments, an antenna of a wireless electronic device may include a support layer, a radiating element layer on the support layer, an attachment layer on the radiating element layer, a package support layer on the attachment layer, a millimeter wave (mmW) antenna array on the package support layer and an mmW circuit on the package support layer. The mmW circuit may include circuit logic for feeding signals to mmW antennas of the mmW antenna array.

In some embodiments, the mmW circuit further may include an mmW transceiver and/or phase control circuit logic. In other embodiments, the mmW circuit may also include radio frequency front end circuit logic.

In some embodiments, the antenna may include a grounding element attached to the radiating element layer. The grounding element may include a power trace to provide power to the mmW circuit and a control line to provide control signals to the mmW circuit.

In some embodiments, the mmW circuit may be printed within a perimeter of the surface of the package support layer and the package support layer may be positioned with a perimeter of the surface of the radiating element layer.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION

Figure 1:
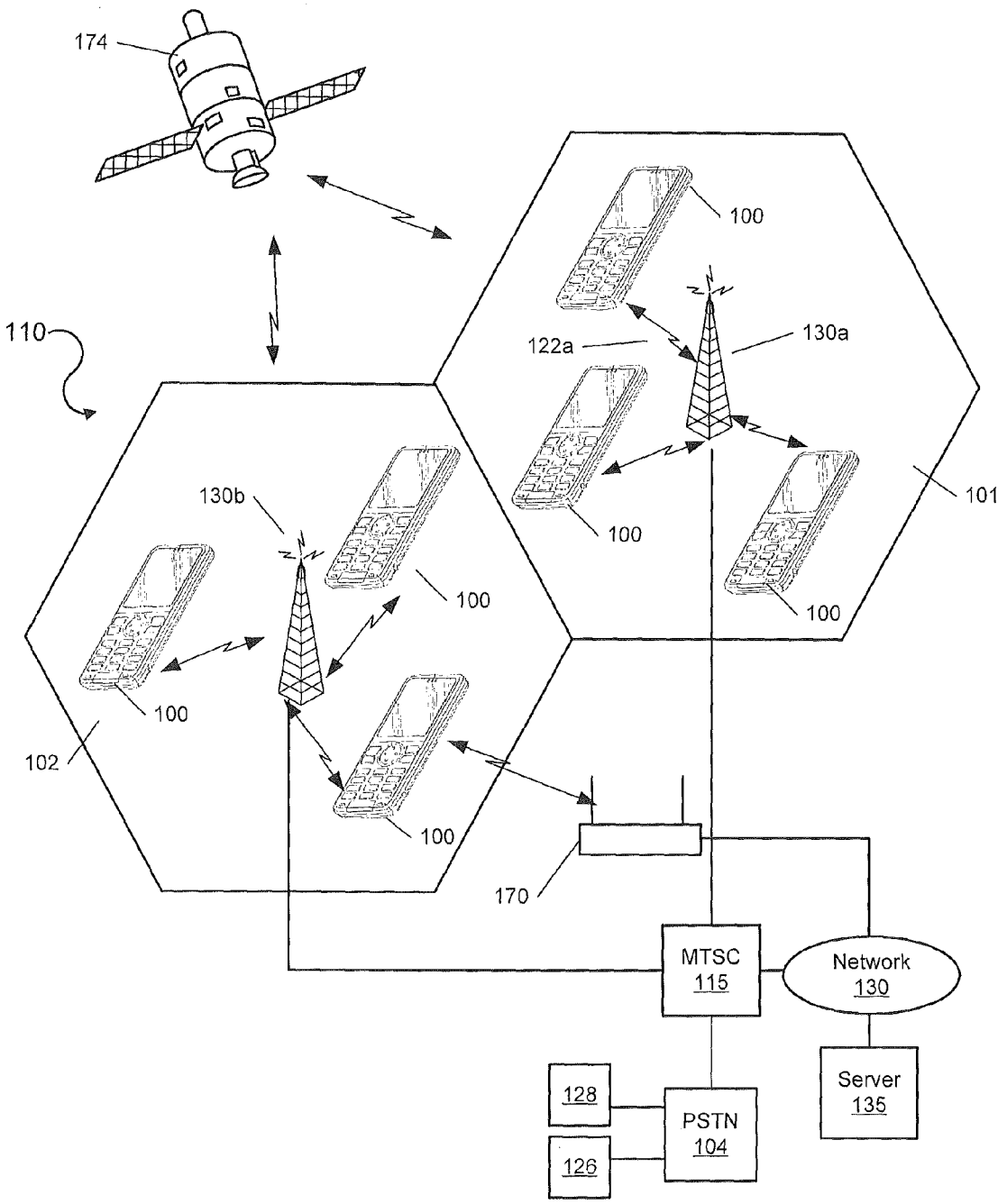
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein the term "and/or" includes any and all combinations of one or more of the associated listed items.

Spatially relative terms, such as "above," "below," "upper," "lower," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in one or more frequency bands. Moreover, the terms "about" and "substantially," as described herein, mean that the recited number or value can vary by +/−25%.

Referring to FIG. 1, a diagram is provided of a wireless communications network 110 that supports communications in which wireless electronic devices 100 can be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. The network 110 may include wireless electronic devices 100 that may communicate with the base stations 130*a*, 130*b*. The wireless electronic devices 100 in the network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to the network 110. As also shown in FIG. 1, the MTSC 115 is coupled to a computer server 135 via a network 130, such as the Internet.

The network 110 is organized as cells 101, 102 that collectively can provide service to a broader geographic region. In particular, each of the cells 101, 102 can provide service to associated sub-regions (e.g., regions within the hexagonal areas illustrated by the cells 101, 102 in FIG. 1) included in the broader geographic region covered by the network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. Each of the cells 101, 102 may include an associated base station 130*a*, 130*b*. The base stations 130*a*, 130*b* can provide wireless communications between each other and the wireless electronic devices 100 in the associated geographic region covered by the network 110.

Each of the base stations 130*a*, 130*b* can transmit/receive data to/from the wireless electronic devices 100 over an associated control channel. For example, the base station 130*a* in cell 101 can communicate with one of the wireless electronic devices 100 in cell 101 over the control channel 122*a*. The control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. The network 110 may also provide network location information as the basis for the location information applied by the wireless electronic devices 100. In addition, the location information may be provided directly to the server 135 rather than to the wireless electronic devices 100 and then to the server 135. Additionally or alternatively, the wireless electronic devices 100 may communicate with the local wireless network 170.

Figure 2:
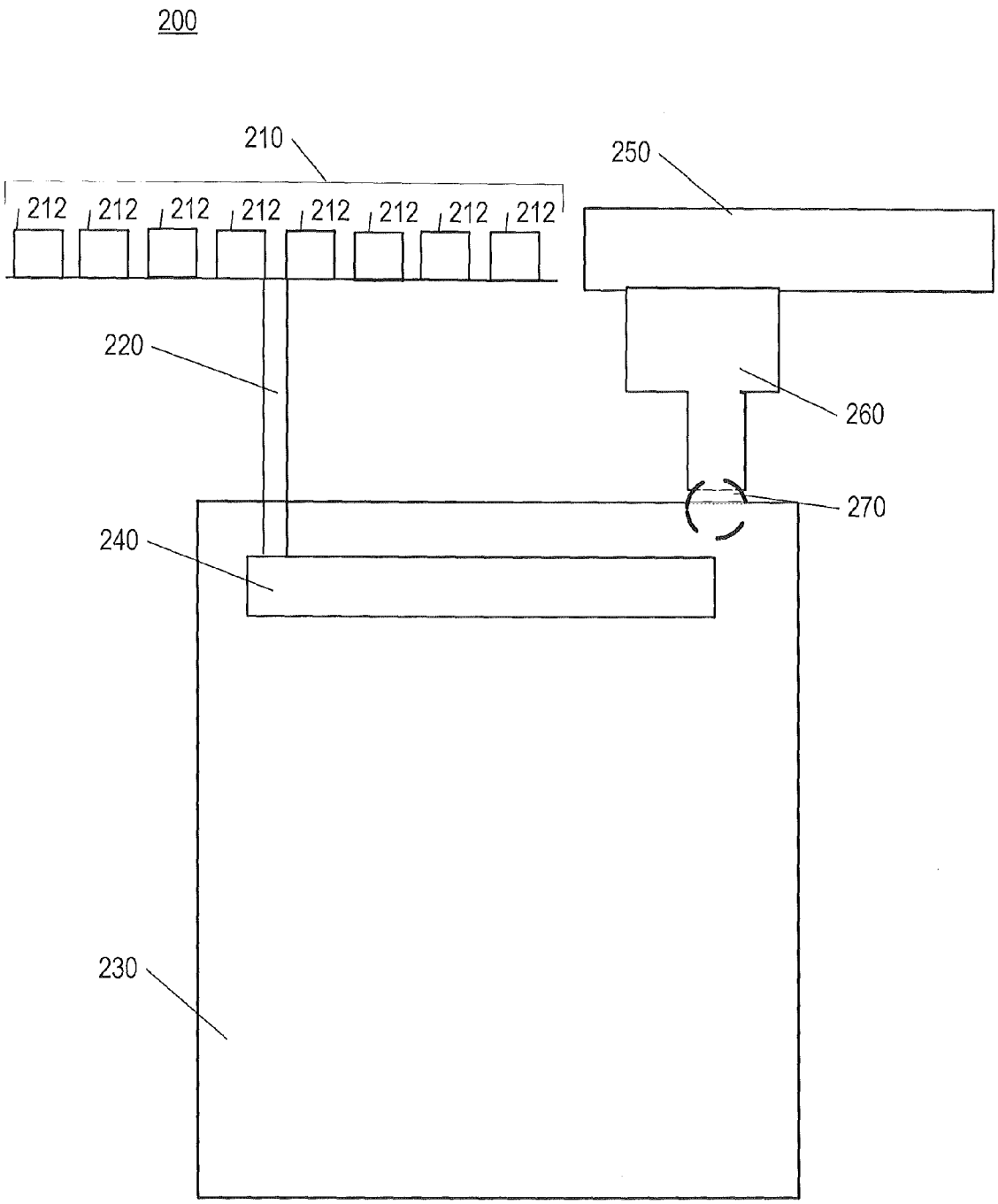
FIG. 2 is a diagram illustrating an internal portion of a wireless electronic device.

FIG. 2 shows an internal portion of a wireless electronic device, also referred to as mobile terminal 100. Mobile terminal 100 may include one or more cellular antennas. Cellular antenna 250 is represented by a block in FIG. 2 for explanatory purposes and may comprise different sizes, shapes or radiating elements. A feeding element 260 may be coupled to cellular antenna 250 and to ground plane 230. The feeding element 260 may be connected to ground plane 210. The coupling to ground plane 230 may also be capacitive as shown by capacitive coupling 270.

Figure 3:
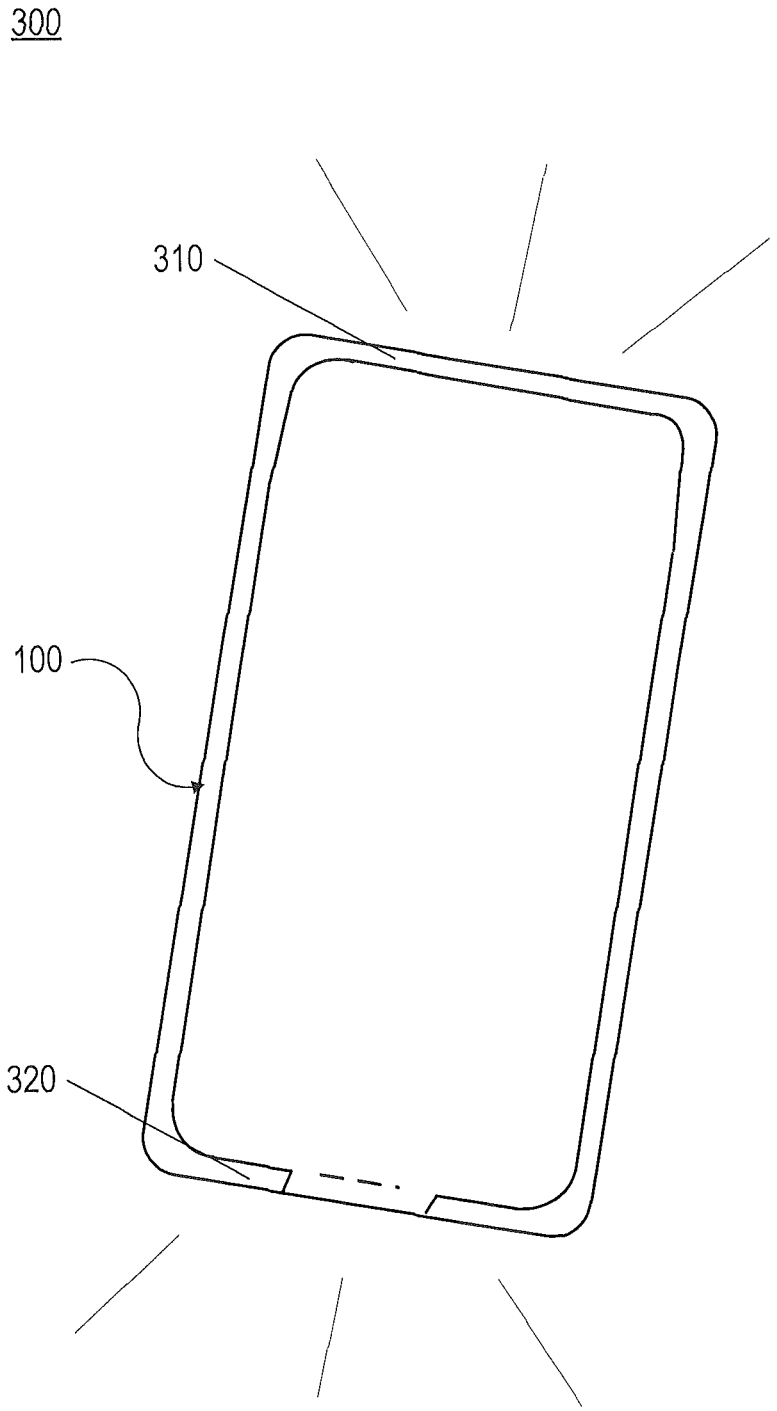
FIG. 3 illustrates a wireless electronic device, according to various embodiments.

A user's hand may block cellular transmission signals. Therefore, cellular antennas are located at the top and/or bottom of the phone so as to not be located where a user will hold a phone. For example, an LTE-Advanced mobile device's capability may benefit from two high performance cellular antennas. Good transceiver performance of two cellular antennas may be necessary for dual transceiver multiple-in-multiple-out (MIMO) schemes and for carrier aggregation in the different operating bands. As shown in diagram 300 of FIG. 3, a base antenna may radiate from a location at bottom 320 of mobile terminal 100 and a diversity antenna may be located at a top 310 of mobile terminal 100.

Wireless networks may also include hardware and software elements for transmission at millimeter wave (mmW) bands. An mmW array 210, including an array of mmW antennas 212, may be included in mobile terminal 100. The mmW array 210 may be connected to ground plane 230 through element 220. However, signals at millimeter wavelengths are susceptible to transmission loss from external factors such as hand-blocking, atmospheric attenuation and other obstacles in the transmission path. Mobile terminals may also suffer internal transmission loss due to the distance from the mmW feeding circuit 240 to the beam-forming mmW antenna array 210. Some losses may be due to ohmic or dielectric properties of transmissions over a distance.

If mmW antenna array 210 is to be included in a cellular wireless device, such as mobile terminal 100, there may be some transmission loss associated with the locations of the mmW antenna array 210, the cellular antenna 250 and the mmW feeding circuitry 240 on the printed circuit board (PCB), such as the PCB corresponding to ground plane 230.

Figure 4:
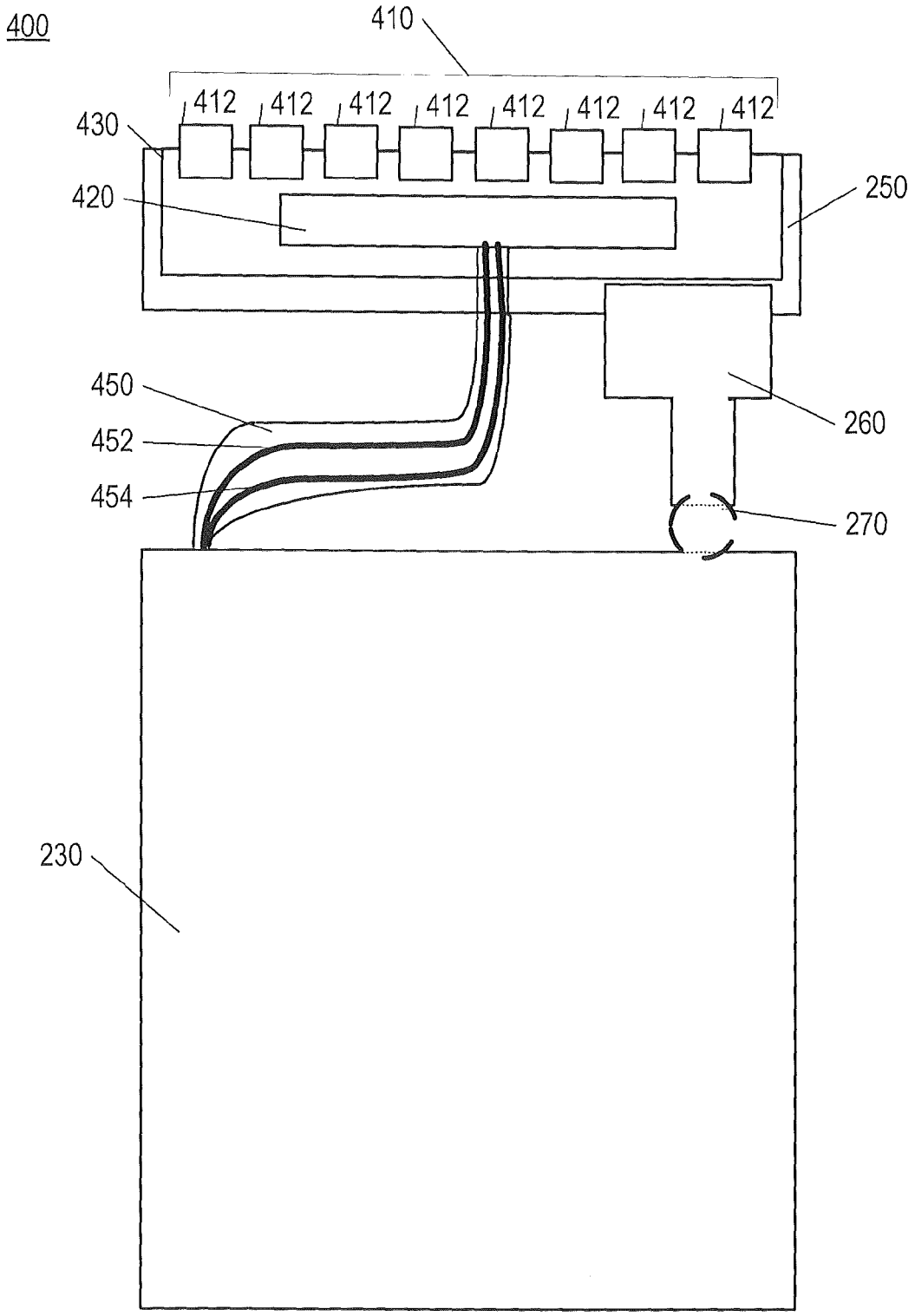
FIG. 4 is a diagram illustrating an internal portion of a wireless electronic device utilizing cellular and millimeter wave (mmW) bands for transmission, according to various embodiments.

Various embodiments described herein, however, may provide for less transmission loss. FIG. 4 shows a diagram 400 of an internal portion of a mobile terminal 100, according to various embodiments. An mmW beam-forming antenna, such as mmW antenna array 410 may be attached to a surface of cellular antenna 250. MmW antenna array 410 may include a plurality of mmW antennas 412 which may each be several millimeters wide. The mmW antennas 412 may each be configured to send and receive mmW signals.

MmW antenna array 410 may be coupled to circuit 420. Circuit 420 may be an integrated circuit that includes mmW circuitry for feeding mmW signals to the mmW antennas 412 of the mmW antenna array 410. Circuit 420 may also include a transceiver for the mmW antenna array 410. Circuit 420 may be attached to a surface of a radiating element, such as cellular antenna 250.

MmW antenna array 410 and circuit 420 may be part of the same package or module, such as indicated by integrated module 430. Circuit 420 may be a printed circuit, or otherwise integrated circuit, coupled to mmW antenna array 410 in integrate module 430. In some embodiments, circuit 420 and/or integrated module 430 may be a monolithic microwave integrated circuit (MMIC). One or more mmW transceivers and/or a phase control circuit may be integrated into circuit 420 and/or integrated module 430. Integrated module 430 may be attached to cellular antenna 250 by an adhesive or other attachment layer. This attachment layer may insulate integrated module 430 from cellular antenna 250.

Figure 6:
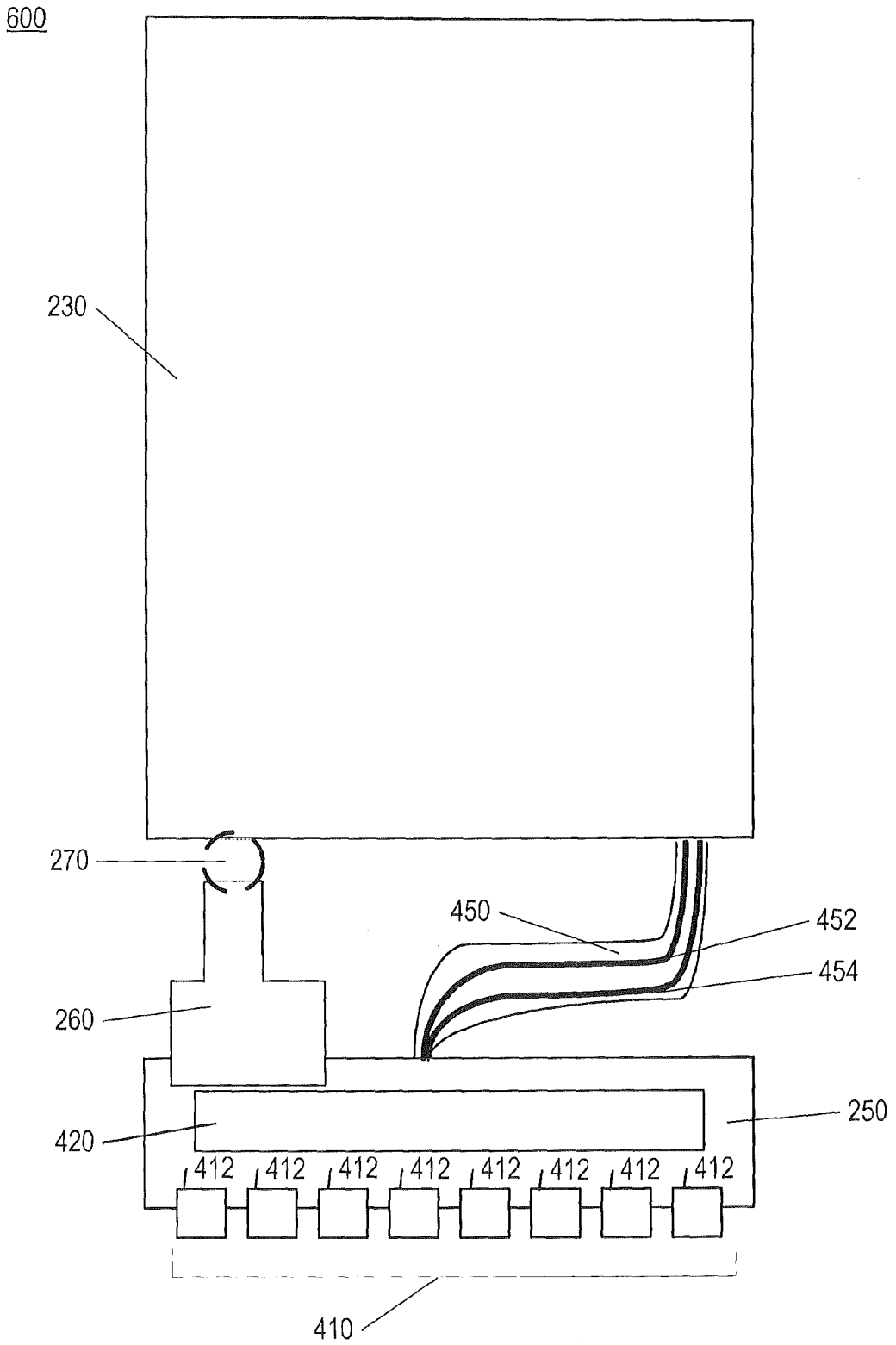
FIG. 6 is a diagram illustrating an internal portion of a wireless electronic device, according to various embodiments.

In various embodiments, the location and configuration of circuit 420 may be optimized to improve the transmission properties of the device. Circuit 420 may be wholly located within a perimeter of a surface of cellular antenna 250. Circuit 420 may also be located in close proximity to mmW antenna array 410 so as to reduce the distance between the elements. For example, circuit 420 is shown in FIG. 4 as a strip so as to fit on cellular antenna 250 in close proximity to mmW antenna array 410. However, in other embodiments, integrated module 430 and/or circuit 420 may be of different sizes and shapes as necessary to optimize transmission properties, antenna design and chassis design. For example, circuit 420 may be smaller and located off center or to a side of cellular antenna 250. In other embodiments, circuit 420 may involve multiple separate circuits, but all on cellular antenna 250. In some embodiments, cellular antenna 250 and integrated module 430 with mmW antenna array 410 may be located at a bottom of mobile terminal 100, as shown in view 600 of FIG. 6.

According to further embodiments, grounding element 450 may couple circuit 420 and/or integrated module 430 to ground plane 230. Grounding element 450 may include an mmW antenna array control 452 for sending control signals to mmW antenna array 410 through integrated module 450. MmW antenna control 452 may be a line, trace and/or film. In further embodiments, circuit modules or other circuitry may be included on the trace or film of mmW antenna control 430 on grounding element 450. With mmW antenna control 452 located on grounding element 450, the distance to mmW antenna array 410 is shortened without interfering with a placement of integrated module 430 on cellular antenna 250.

In some embodiments, grounding element 450 may also include a power line trace 454. Although a dark line is used to represent power line trace 454, the power line trace 454 may be a trace or film shaped as appropriate to provide power from the PCB to the integrated module 430. In some embodiments, grounding element 450 may comprises a flexible material.

Cellular antenna 250 may be coupled to ground plane 230 through grounding element 450. Feeding element 260, cellular antenna 250 and grounding element 450 may form an antenna loop with ground plane 230. In some embodiments, these elements may also form a PIFA antenna.

Figure 5:
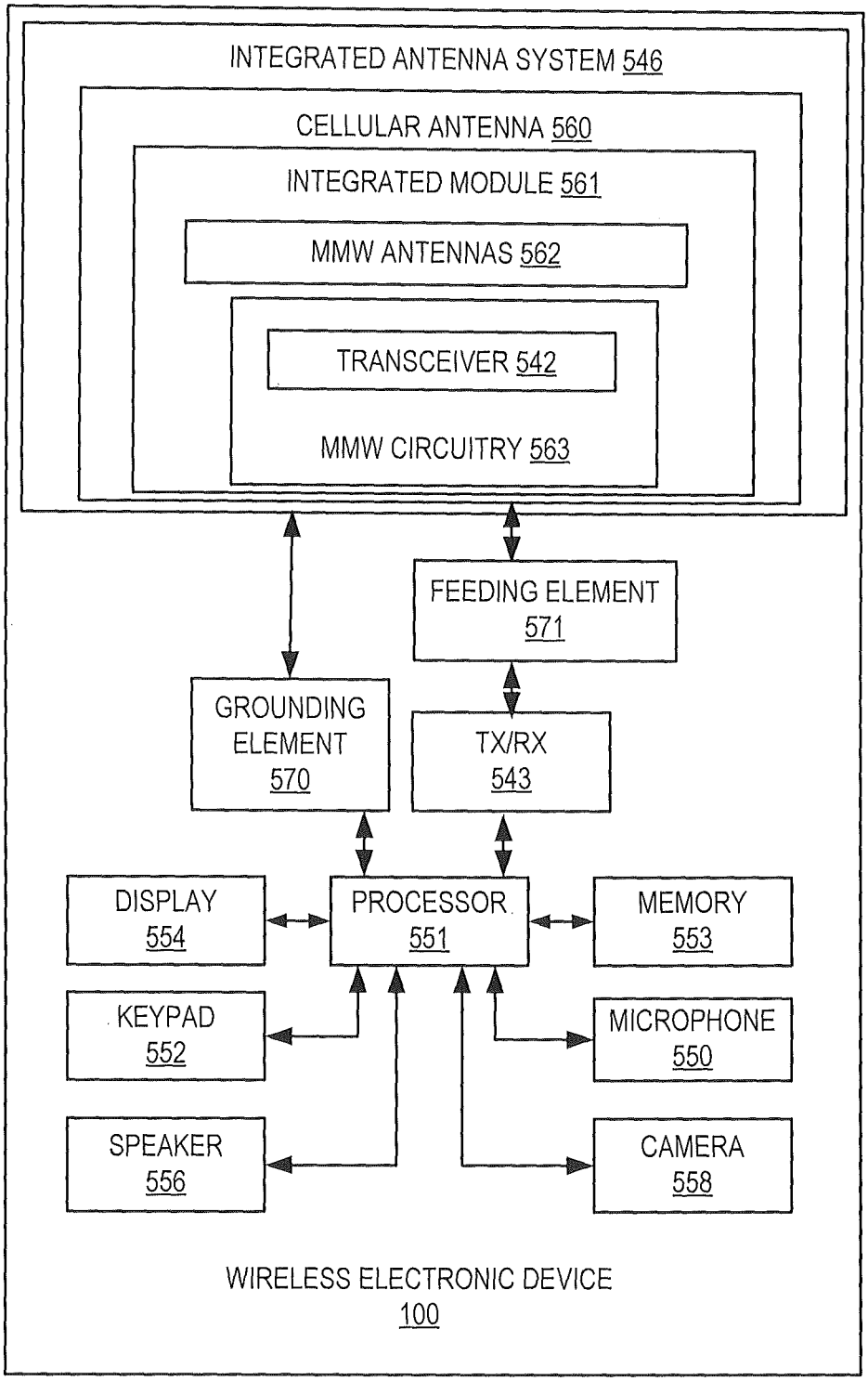
FIG. 5 is a diagram illustrating a wireless electronic device, according to various embodiments.

FIG. 5 illustrates a block diagram of a wireless electronic device 100, according to various embodiments. As illustrated in FIG. 5, a wireless electronic device 100 may include an integrated antenna system 546, a cellular transceiver 543, and a processor 551. The wireless electronic device 100 may further include a display 554, keypad 552, speaker 556, memory 553, microphone 550, and/or camera 558.

A transmitter portion of the cellular transceiver 543 converts information, which is to be transmitted by the wireless electronic device 100, into electromagnetic signals suitable for radio communications (e.g., to the network 110 illustrated in FIG. 1). A receiver portion of the transceiver 543 demodulates electromagnetic signals, which are received by the wireless electronic device 100 from the network 110 to provide the information contained in the signals in a format understandable to a user of the wireless electronic device 100. The transceiver 543 may include transmit/receive circuitry (TX/RX) that provides separate communication paths for supplying/receiving RF signals to different cellular radiating elements of the integrated antenna system 546. Accordingly, when the integrated antenna system 546 includes several active antenna elements (e.g., the cellular antenna 560, RF or mmW antennas 562), the transceiver 543 may include two or more transmit/receive circuits or any other RF front end circuitry connected to different ones of the antenna elements via the respective RF feeds. Feeding element 571 may feed signals to integrated antenna system 546. Integrated antenna system 546 may be grounded by grounding element 570.

The transceiver 543, in operational cooperation with one or more cellular antennas 560 of integrated module 561 and processor 551, may be configured to communicate according to at least one radio access technology in two or more frequency ranges. The at least one radio access technology may include, but is not limited to, WLAN (e.g., 802.11/WiFi), WiMAX (Worldwide Interoperability for Microwave Access), TransferJet, 3GPP LTE (3rd Generation Partnership Project Long Term Evolution), 4G, 5G, mm Wave, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, 2500-2700 MHz. Other radio access technologies and/or frequency bands can also be used in embodiments according to the inventive concepts. Various embodiments may use antennas 561 to provide coverage for non-cellular frequency bands such as Global Positioning System (GPS), WLAN, and/or Bluetooth® frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth® compliant interface.

Transceiver 542 of mmW circuitry 563 may be configured to transmit and receive mmW signals over mmW antennas 562. Transceiver 542 may operate in a similar fashion as transceiver 543, but for mmW signals in the high GHz bands. Grounding element 570 may provide power and control signals for mmW transmission to integrated module 561.

The wireless electronic device 100 is not limited to any particular combination or arrangement of the keypad 552 and the display 554. As an example, it will be understood that the functions of the keypad 552 and the display 554 can be provided by a touch screen through which the user can view information, such as computer displayable documents, provide input thereto, and otherwise control the wireless electronic device 100. Additionally or alternatively, the wireless electronic device 100 may include a separate keypad 552 and display 554.

Memory 553 can store computer program instructions that, when executed by the processor circuit 551, carry out the operations described herein and shown in the figures. As an example, the memory 553 can be non-volatile memory, such as EEPROM (flash memory), that retains the stored data while power is removed from the memory 553.

Figure 7:
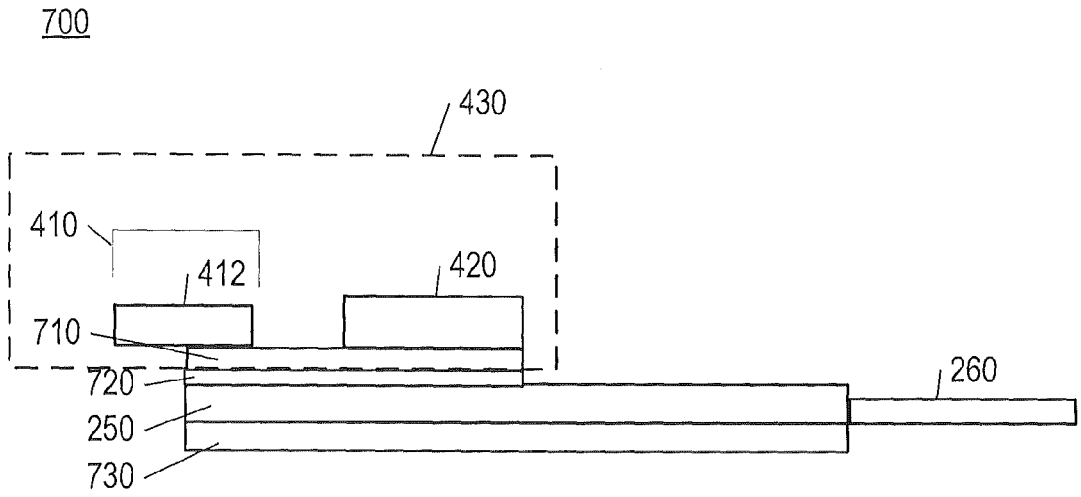
FIG. 7 is a diagram illustrating a side view of a cellular antenna stack of a wireless electronic device, according to various embodiments.

FIG. 7 is a diagram illustrating a side view 700 of a cellular antenna stack of a wireless electronic device, according to various embodiments. MmW antenna array 410 is shown with a first mmW antenna 412 integrated on a same package layer, such as layer 710. The package layer 710 may be attached to cellular antenna 250 with attachment layer 720, which may include an adhesive or other means of attachment. Feeding element 260 may be coupled to the same layer as the cellular antenna 250. Cellular antenna 250 may be formed on a support layer 730. Cellular antenna 250 may be comprised of a metal ring, plate or strip. Support layer 730 may be conductive and may comprise a metal such as copper.

Circuit 420 may be attached to the surface of the cellular antenna 250 by package layer 710 and attachment layer 720. Attachment layer 720 may include an insulating adhesive. Circuit 420 may be attached to package layer 710 by yet another attachment layer, if necessary.

Figure 8:
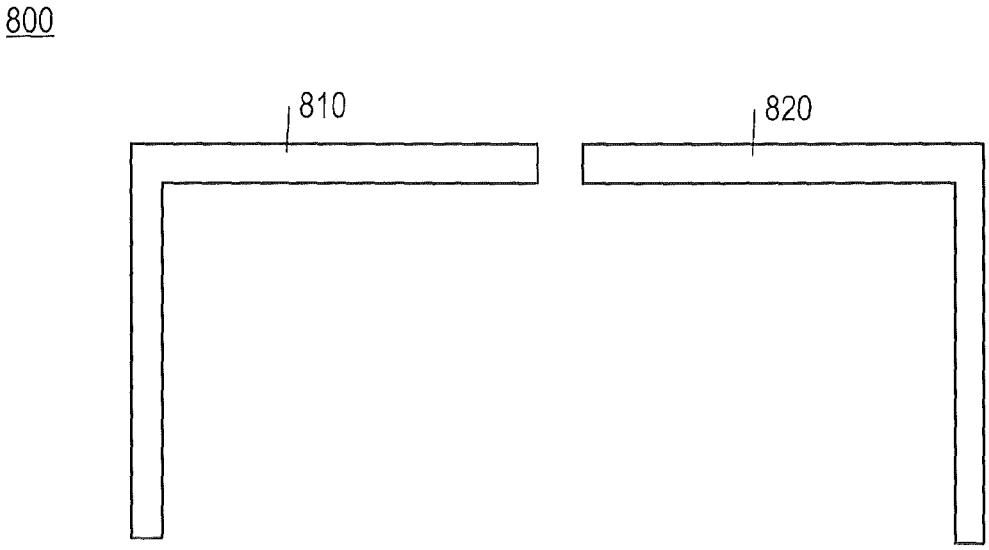
FIG. 8 is a diagram illustrating another view of a cellular antenna of a wireless electronic device, according to various embodiments.

FIG. 8 is a diagram 800 illustrating another view of cellular antenna 250. Cellular antenna 250 may involve multiple antennas of varying shape and location. For example, FIG. 8 shows cellular antennas 810 and 820 of a wireless electronic device, according to various embodiments. Cellular antenna 810 or 820 may be a metal strip around a portion of a perimeter of mobile terminal 100. Antenna elements and circuits may be attached to this metal strip.

Figure 9:
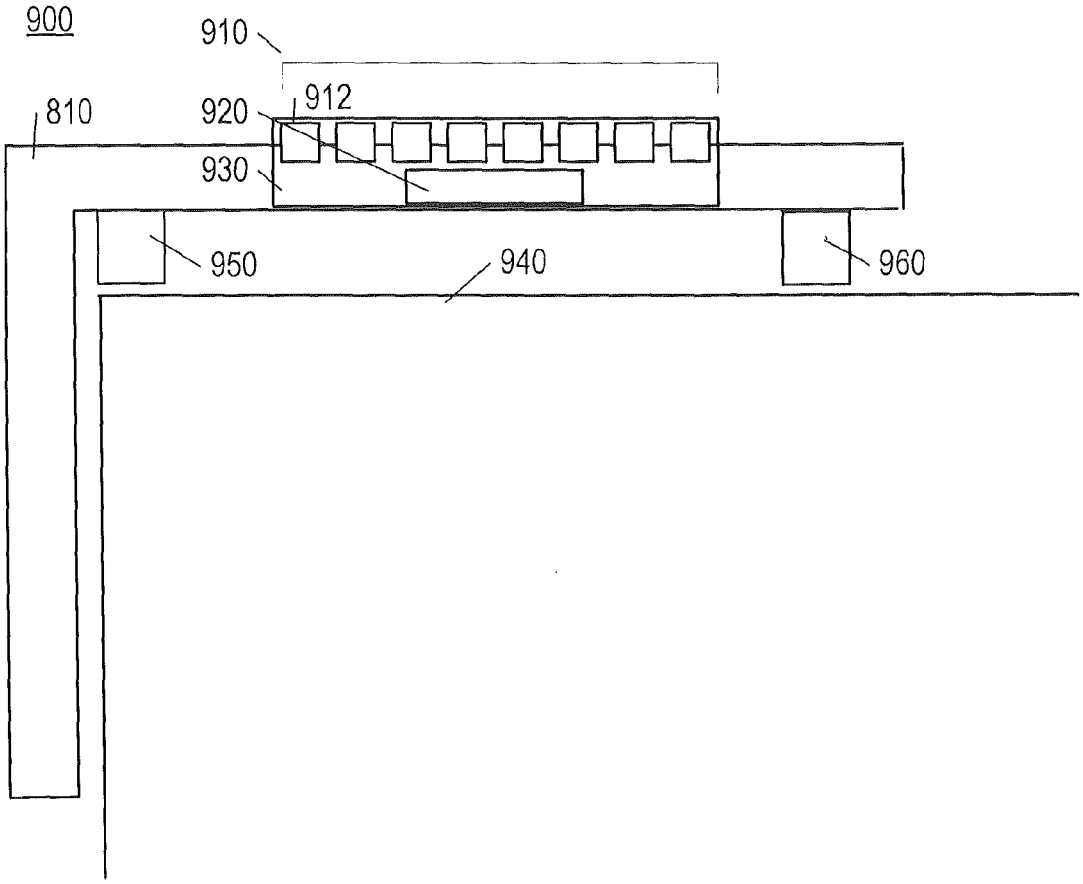
FIG. 9 is a diagram illustrating an mmW antenna array on a cellular antenna of a wireless electronic device, according to various embodiments.

FIG. 9 is a diagram 900 illustrating mmW antennas 912 in an mmW antenna array 910 on a cellular antenna 810 of a wireless electronic device. Circuit 930 may contain mmW circuit logic for beam-forming using mmW antennas 912. Circuit 930 may also include feeding network circuit logic, transceiver logic and/or phase control circuit logic. MmW antenna array 910 and circuit 920 may be part of the same integrated module 930. Integrated module 930 may include a package layer that circuit 920 is printed onto and an mmW antenna array 910 that circuit 920 is coupled to in close proximity. In some cases, circuit logic (circuit components for performing operations rather than just carrying a signal) of circuit 920 may be located within half of the surface of the cellular antenna 810, the surface where the mmW antenna array 910 is located.

In some embodiments, integrated module 930 may be located substantially in the middle of antenna 810. In some embodiments, integrated module 930 may be located towards an edge of antenna 810 or may be located on antenna 820. In other embodiments, integrated module 930 may include circuit 920 on one side of antenna 810 and mmW antenna array 910 on an adjacent perpendicular side of antenna 810.

Grounding element 950 may include an mmW array control and a power trace for controlling and powering mmW antennas 912. Feeding element 960 may feed cellular antenna 810. In some embodiments, antenna 810 may be LTE antennas. In other embodiment, antenna 810 may be a WiFi or other radio antenna, such as a Bluetooth™ antenna. In some embodiments, antenna 810 may be a GPS antenna, Antennas 810 and 820 may be located at different edges, sides or corners of the wireless mobile terminal.

Various embodiments described herein may provide for less transmission loss for integrated cellular and mmW applications.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

a ground plane;

a cellular antenna;

a millimeter wave (mmW) antenna array coupled to a surface of a radiating element of the cellular antenna, the radiating element of the cellular antenna being a radiating element for signals transmitted or received by the cellular antenna; and an mmW circuit attached to the surface of the cellular antenna and coupled to the mmW antenna array, the mmW circuit comprising circuit logic for feeding signals to mmW antennas of the mmW antenna array.

2. The wireless electronic device of claim 1, wherein the mmW circuit further comprises an mmW transceiver.

3. The wireless electronic device of claim 2, wherein the mmW circuit further comprises phase control circuit logic.

4. The wireless electronic device of claim 1, further comprising a grounding element extending between the ground plane and the cellular antenna.

5. The wireless electronic device of claim 4, wherein the grounding element further comprises a power trace to provide power from circuitry on the ground plane to the mmW circuit.

6. The wireless electronic device of claim 5, wherein the grounding element further comprises an mmW control line to provide mmW control signals from circuitry on the ground plane to the mmW circuit.

7. The wireless electronic device of claim 6, wherein the power trace and the mmW control line are integrated on a flexible film.

8. The wireless electronic device of claim 4, further comprising a feeding element coupled between the ground plane and the cellular antenna, wherein the cellular antenna, the grounding element, the feeding element and the ground plane form an antenna loop.

9. The wireless electronic device of claim 1, wherein the mmW circuit logic is located within a perimeter of the surface of the cellular antenna.

10. The wireless electronic device of claim 1, further comprising a grounding element extending between the ground plane and the cellular antenna and a feeding element coupled between the ground plane and the cellular antenna, wherein the mmW antenna array and the mmW circuit are on the surface of the cellular antenna between the grounding element and the feeding element.

11. The wireless electronic device of claim 10, wherein the cellular antenna comprises a continuous metal ring, plate or strip that contacts the grounding element and the feeding element, wherein the mmW circuit is on the cellular antenna within a perimeter of the continuous metal ring, plate or strip.

12. The wireless electronic device of claim 1, wherein the mmW antenna array comprises a plurality of mmW antennas that are configured to send and receive mmW signals and that overlap the surface of the radiating element of the cellular antenna.

13. The wireless electronic device of claim 12, wherein ones of the plurality of mmW antennas comprise respective portions that extend beyond the surface of the radiating element of the cellular antenna.

14. An antenna of a wireless electronic device, comprising:

a support layer;

a radiating element layer on the support layer;

an attachment layer on the radiating element layer;

a package support layer on the attachment layer;

a millimeter wave (mmW) antenna array on the package support layer; and an mmW circuit on the package support layer, the mmW circuit comprising circuit logic for feeding signals to mmW antennas of the mmW antenna array.

15. The antenna of claim 14, wherein the mmW circuit further comprises an mmW transceiver.

16. The antenna of claim 15, wherein the mmW circuit further comprises phase control circuit logic.

17. The antenna of claim 16, wherein the mmW circuit further comprises radio frequency front end circuit logic.

18. The antenna of claim 14, further comprising a grounding element attached to the radiating element layer, wherein the grounding element further comprises a power trace to provide power to the mmW circuit and a control line to provide control signals to the mmW circuit.

19. The antenna of claim 14, wherein the mmW circuit is printed within a perimeter of the surface of the package support layer and wherein the package support layer is positioned with a perimeter of the surface of the radiating element layer.

20. The wireless electronic device of claim 14, wherein the mmW antenna array and the mmW circuit are on a portion of the package support layer that is on a radiating element of the radiating element layer for signals transmitted or received by the radiating element of the antenna.

21. The wireless electronic device of claim 14, further comprising a grounding element attached to the radiating element layer and extending to a ground plane and a feeding element coupled between the ground plane and the radiating element layer, wherein the mmW antenna array and the mmW circuit are on the package support layer between the grounding element and the feeding element.

22. The wireless electronic device of claim 21, wherein the radiating element layer comprises a continuous metal ring, plate or strip that contacts the grounding element and the feeding element, wherein the mmW circuit is on the package support layer within a perimeter of the continuous metal ring, plate or strip.

* * * * *